United States Patent [19]

Fegley

[11] 4,394,934

[45] Jul. 26, 1983

[54] FLUID DISPENSING ANTI-BURGLAR DEVICE

[76] Inventor: Charles R. Fegley, 1606 Frush Valley Rd., Laureldale, Pa. 19605

[21] Appl. No.: 242,053

[22] Filed: Mar. 9, 1981

Related U.S. Application Data

[63] Continuation of Ser. No. 53,990, Jul. 2, 1979, abandoned.

[51] Int. Cl.[3] ..... B67B 7/24

[52] U.S. Cl. ..... 222/5; 222/162; 222/639

[58] Field of Search ..... 222/3, 5, 54, 61, 70, 222/76, 160, 162; 109/20, 21, 29, 31–33, 38, 39; 116/5, 6, 75, 85, 86, 100, 106; 239/274; 340/527–530, 545, 309.1; 337/1, 2, 4, 401; 200/61, 93

[56] References Cited

U.S. PATENT DOCUMENTS

| | | | |
|---|---|---|---|
| 2,317,942 | 4/1943 | Sabini | 222/5 |
| 3,180,524 | 4/1965 | Shepard et al. | 337/401 X |
| 3,359,804 | 12/1967 | Phillips | 337/4 X |
| 3,531,793 | 9/1970 | Shottenfeld | 340/545 X |
| 3,967,757 | 7/1976 | Fegley | 222/5 |
| 3,972,447 | 8/1976 | Fegley | 222/5 |
| 4,062,473 | 12/1977 | Fegley | 222/5 |

FOREIGN PATENT DOCUMENTS

| | | | |
|---|---|---|---|
| 2370330 | 6/1978 | France | 340/528 |

OTHER PUBLICATIONS

*Linear Data Book,* National Semiconductor Corp., Jun. 1976, pp. 9–23 & 9–29.

*Primary Examiner*—Robert B. Reeves
*Assistant Examiner*—Edward M. Wacyra

[57] ABSTRACT

A fluid dispensing anti-burglar device is disclosed in which a chemical irritant such as tear gas is discharged into the area to be protected when an intruder forces entry into the area to be protected with which the device is associated. The anti-burglar device employs electrical elements for causing the release of the irritant gas and includes provisions for time delayed release of the chemical irritant.

27 Claims, 22 Drawing Figures

FLUID DISPENSING ANTI-BURGLAR DEVICE

This is a continuation of Ser. No. 053,990 filed July 2, 1979, now abandoned.

BACKGROUND OF THE INVENTION

The invention relates generally to an anti-burglary device and more particularly to an anti-burglary device which discharges a chemical irritant such as tear gas from a pressurized container, one type of which is an aerosol container, into a protected area upon actuation by an unauthorized person, causing the protected area to be flooded with the chemical irritant and thereby forcing evacuation of the protected area by the intruder.

Chemical weapons have been known in the art for many years. One type of chemical weapon is the conventional tear gas grenade which is generally triggered manually and the grenade is manually hurled at a target area, causing the target area to be flooded with the chemical irritant.

In another type of chemical weapon, the chemical irritant is stored under pressure in an aerosol type container. The actuating member is again generally triggered manually and the chemical irritant in the form of a spray is manually directed at the target.

A third type of chemical weapon is in the form of an anti-burglar device which discharges an explosive tear gas shell into the area but this type is both dangerous and very limited as to the amount of tear gas which is discharged into the area to be protected.

A fourth type of chemical weapon is in the form of an anti-burglary device which is of the booby trap type in which a pressurized container releases its contents into an area to be protected. This type of device, when accidentally tripped by a person authorized to be in the protected area, cannot be de-activated and discharges its contents into the area forcing the authorized personnel to leave the protected area.

Thus, what is needed is an anti-burglar device in the form of a chemical irritant dispenser which can be electrically actuated to dispense the chemical irritant and a time delay electric circuit to provide a timed delay of the dispensing of the chemical irritant. The time delay, upon circuit energization, will permit an authorized person who enters a protected area and accidentally triggers the system to reset it before the device discharges the chemical irritant.

SUMMARY OF THE INVENTION

The principle object of the present invention is to provide an anti-burglar device of the fluid dispensing type which will be actuated by the closure of an electric switch and contain a time delay which will provide a time delay between the actuation of a switch and the release of fluid. This time delay permits the anti-burglar device to be deactuated by authorized personnel if the device is accidentally energized; yet the time delay is not long enough to permit an intruder to locate the control switch to deactuate the circuit.

A further object of the invention is to provide an anti-burglar device of the chemical weapon type which is readily triggered by opening a door or window by an intruder entering an unauthorized area or by moving an object with which the device is connected.

Another object of the invention is to provide an improved means of dispensing fluid into a protected area in a minimum amount of time in order to force an intruder from the protected area and to prevent the intruder from re-entering the area for a reasonable amount of time.

A further object of the invention is to provide an anti-burglary device having means for reloading the device and resetting the trigger after the device has been discharged.

Another object of the present invention is to provide a directable discharge of the fluid, such as by means of a rotatably adjustable dispensing head, so that the device can be located on a door, wall, or the like, and yet, when the device is actuated, the fluid is directed into the area to be protected.

According to the principle aspect of the present invention there is provided an improved means for releasably retaining spring biased elements in a cocked position. Such means includes a spring biased trigger adapted to be movably mounted between an actuation position and a release position. The spring biased trigger is biased toward the release position and held in the actuation position by an electric release element. A time delay circuit is included to provide a timed delay of the spring biased trigger by the electric release element and, therefore delay the release of the irritating gas.

When the anti-burglar device is connected to a power source, a buzzer, an on-off switch and sensor switch associated with an area to be protected; an intruder entering the protected area and energizing the circuit will cause the buzzer to sound. After a preset timed delay, the electric release element will release the trigger and cause fluid discharge, thereby, forcing the intruder from the protected area. However, an authorized person entering the area and accidentally tripping a sensor will hear the buzzer and be able to reset the system before the gas is discharged.

The anti-burglary device of the present invention may be utilized in homes, factories, farms or office buildings and may also be used in connection with vehicles such as boats, trucks, airplanes, etc. The device may also be employed for any other application wherein it is desired to prevent unauthorized persons from moving certain objects by placing the sensor switches against the object.

Once actuated and after the time delay, the device will dispense the entire amount of fluid in the pressurized container into the protected area making it impossible for the intruder to remain in the protected area without having protective equipment.

Other objects, aspects and advantages of the invention will become apparent from the following description taken in connection with the accompanying drawings.

DESCRIPTION OF THE PREFERRED EMBODIMENTS

Figure 1:
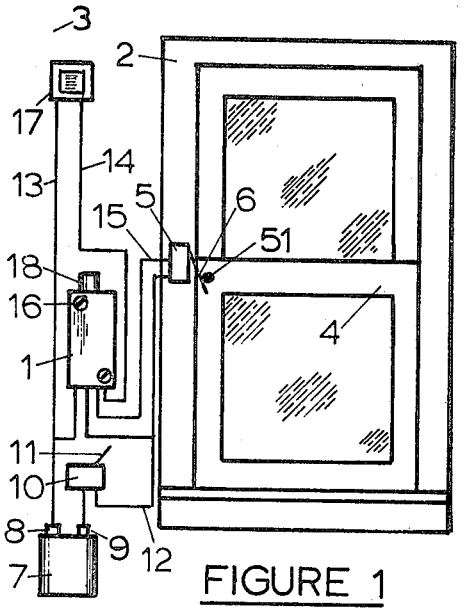
FIG. 1 is an elevational view of a wall of a room having one embodiment of the fluid dispensing anti-burglar device secured to the wall and connected by means of an electric circuit and a switch to the sash of a window in the wall.

Referring now to the drawings in detail, wherein like reference characters designate like parts through the various views, there is shown in FIGS. 1–7, one form of the fluid dispensing anti-burglar device, called device hereafter, of the chemical weapon type according to the present invention, generally designated 1. The device 1 may be installed anywhere in an area to be protected and may be connected in series to a switch, an electric power supply, an on-off switch and one or more sensor switches. One such installation is shown in FIG. 1, wherein the device 1 is fastened to a wall 3 and connected in series by means of wires 12, 13 and 15 to an electric power supply, shown for convenience as a battery 7, an on-off switch 10 and a sensor switch, shown for convenience as switch 5 attached to the window frame 2. Sensor switch 5 is of the normally closed type and is mounted in a manner that its actuator arm 6 will be depressed by pin 51 when the window 4 is closed and thereby hold the contacts of switch 5 open. The on-off switch 10 may be placed in any convenient location and a buzzer 17 may be connected to device 1 by wires 13 and 14 to warm that electric current has been supplied to the device 1.

Figure 2:
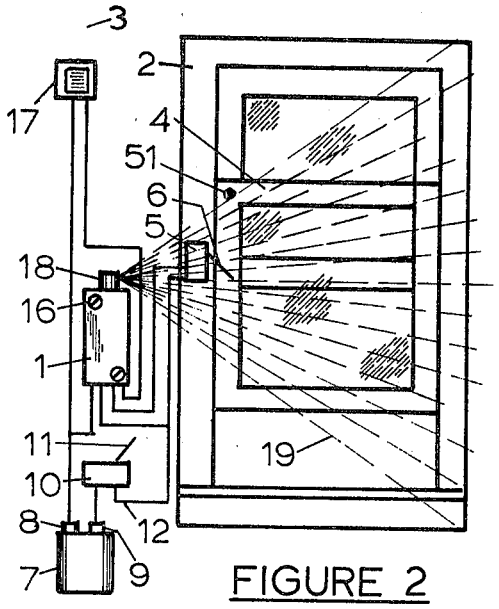
FIG. 2 is an elevational view similar to FIG. 1, but showing the window open and the device dispensing fluid.

With the actuator arm 11 of the on-off switch 10 in the "off" position, the window 4 may be safely opened and closed without causing the device 1 to discharge. When the actuator 11 is in the "on" position, opening of window 4, as shown in FIG. 2, will close the contacts of switch 5 and electric current will flow to device 1. The electronic circuits within device 1 will latch in and buzzer 17 will sound. Closing window 4 will open the contacts of sensor switch 5 but the buzzer will continue to sound and the chemical irritant 19 will be released at the end of the preset time delay. By turning the actuator arm 11 of switch 10 to the "off" position before the time delay causes device 1 to discharge, no electric current is supplied to device 1 causing the buzzer 17 to stop and the time delay is reset and therefore no release of chemical irritant 19. Although the electric power supply is shown as being supplied by an external power source and switch 10 is mounted external of device 1; it is recognized that the switch 10 and/or the electric power supply may be installed inside device 1. It is also recognized that device 1 may be electrically connected in many different types of circuits and is not limited to the above circuit. In addition, the latch-in feature may be bypassed for use in existing alarm systems.

Figure 3:
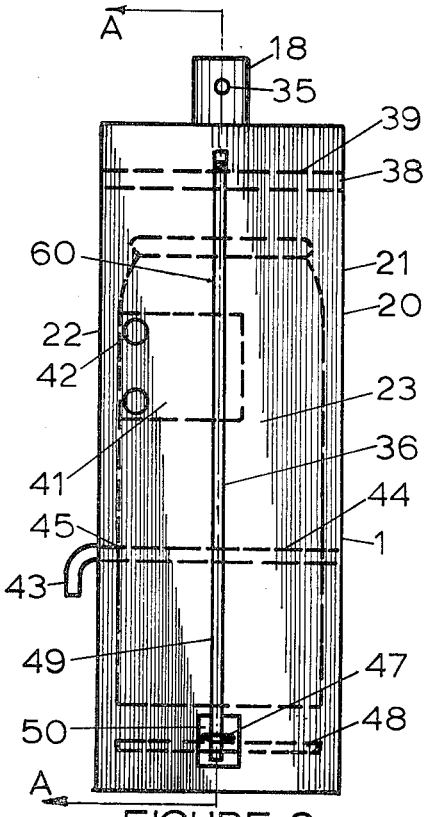
FIG. 3 is a front elevational view of the fluid dispensing anti-burglar device.

The device 1, whose front is shown in FIG. 3, comprises of a pressurized container 23, called container 23 hereafter, mounted in a body member 20 shown for convenience as being comprised of a left body half 22 and a right body half 21. The two body halves 21 and 22 when assembled provide four flat sides for mounting the device 1 to the wall 3 or elsewhere. The holes 28 may be used for attaching device 1 to a wall 3 or elsewhere by screws or nails.

Figure 4:
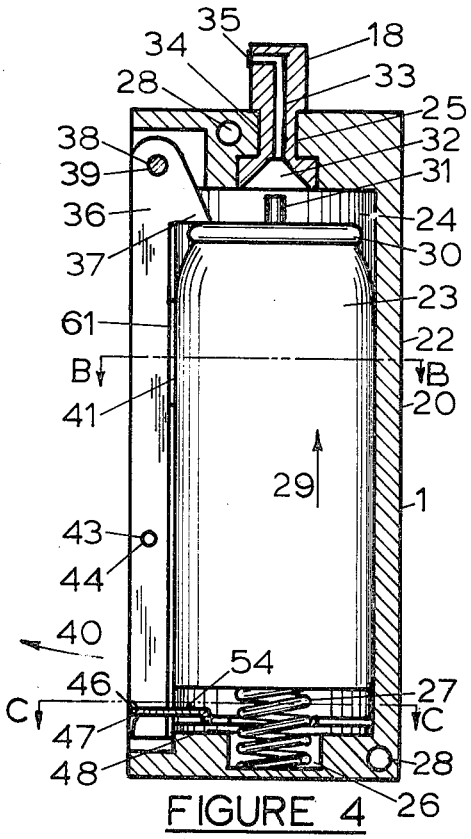
FIG. 4 is a vertical section taken along line A—A of FIG. 3 showing the spring biased elements in a cocked position and the dispensing element displaced from its actuation means.
Figure 5:
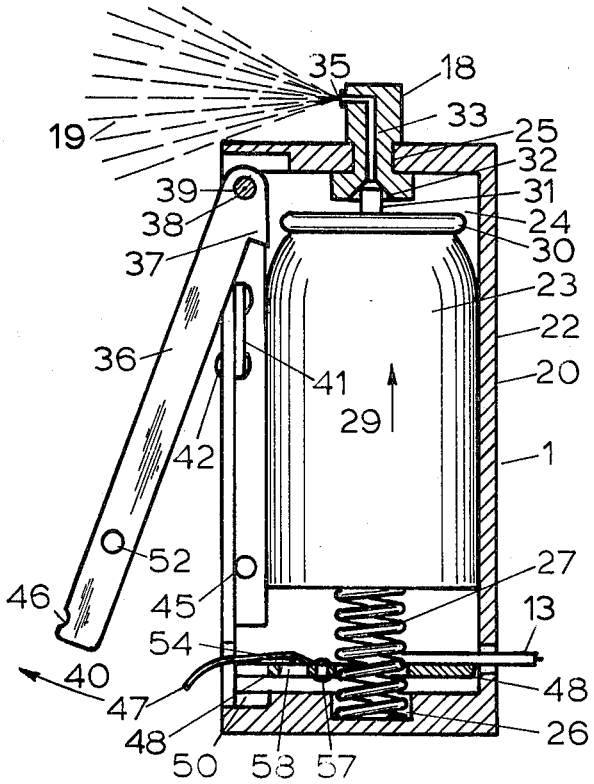
FIG. 5 is a vertical section taken along line A—A of FIG. 3 similar to FIG. 4 but shows the device dispensing fluid.

The coaxial cylindrical bores 24, 25 and 26 as shown in FIGS. 4 and 5, are formed when the symetrically opposite body halves 21 and 22 are joined together as shown in FIGS. 3, 4, 5, 6 and 7. The cylindrical bore generally designated 24, slidably mounts the container 23. The container 23 of which one type is sold by Defense Products Manufacturing Corporation, 1628 South Hanley Raod, St. Louis, Missouri identified as their "Paralyzer" and another type is sold by Penquin Industries, Inc., Parkesburg, Pa. identified as their "10-4 Chemical Billy" but the invention is not limited to the use of these containers. The container 23 includes a fluid dispensing element which comprises of a spring urged projecting dispensing spout 31 which when depressed discharges a fluid 19 through the center of the projecting dispensing spout 31.

Figure 14:
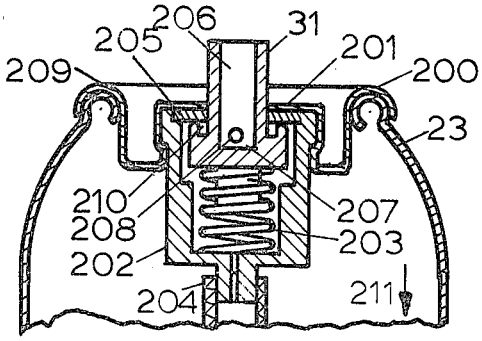
FIG. 14 is a partial vertical section showing a valve for use with the pressurized container having a projecting dispensing spout.

One type of pressurized container 23, shown as having a fluid-dispensing element in the form of a projecting dispensing spout 31, for use in this embodiment is shown in FIG. 14 as containing a valve assembly generally designated 200. Valve assemblies of this type are well known in the trade and one type of which is sold by Scovill, Manchester, New Hampshire as their S-63 valve assembly. The valve assembly 200 is shown as being comprised of a projecting dispensing spout 31 which has generally a hollow the tube portion 206 and is closed at one end 207 thereof. A valve seat 205 is formed around the sealed end 207 of the dispensing spout 31 and contains a recessed portion 210 formed to provide a fluid passageway which will permit fluid flow to a discharge hole 208 and gives fluid access to the hollow tube 206. The dispensing spout 31 is slidably mounted in spring cup 202 and is urged by spring 203 toward the valve seal 201. In this position, the valve seat 205 forms a seal with the valve seal 201. A dip tube 204 may be attached to the spring cup 202 to provide access to fluid when in liquid form in the bottom of the container 23. The assembly is generally mounted in a metal cup 209 which is then fastened to the container 23.

When the projecting dispensing spout 31 is moved in the direction of arrow 211, the valve seat 105 is separated from the valve seal 201 thereby, permitting fluid under pressure to flow up dip tube 204, around the valve seat 205, through the discharge hole 208 and out the hollow tube 206.

Now referring to FIGS. 4 and 5; the cylindrical bore generally designated 26 is coaxial with the cylindrical bore 24 and provides a means for mounting spring 27. The spring 27 is biased to urge the container 23 in the direction of arrow 29.

Again referring to FIGS. 4 and 5, the body member 20 forms a cylindrical bore 25 and provides means for mounting a rotatable dispensing head 18. The dispensing head 18 contains a fluid passageway 33 having an entry section 32 at one end thereof for engaging with the projecting dispensing spout 31 of container 23 and a discharge section 35 on the other end. The dispensing head 18 provides a means for the fluid 19 to be discharged into and directed from when the projecting dispensing spout 31 of the container 23 is forced into the entry section 32 by the spring 27 acting to move the slidably mounted container 23 in the direction of arrow 29. The funnel shape of the entry section 32 engages the projecting dispensing spout 31, which is made of a relatively soft material and therefore provides an adequate seal at the entry section 32 to retain fluid flow in the passageway 33 at pressures normally used in the container 23.

The container 23 in the position illustrated in FIG. 4 is in its cocked position where the spring 27 is compressed and the spout 31 is coaxial but displaced from the entry section 32. The container 23 is releasably restrained in a cocked position by a trigger 36. The trigger 36 is generally a flat member and includes a shaped latch portion 37, holes 38 and 44 and a notch 46 and is best seen in FIGS. 4 and 5. The trigger 36 is rotatably mounted on a pivot pin 39 and is slidably contained in slot 49 formed by the body halves 21 and 22. The shaped latch portion 37 engages the rim 30 of the container 23 when in the cocked position as shown in FIG. 4. The spring 27 urged container 23 causes trigger 36 to rotate counterclockwise as shown in FIG. 4 around pivot pin 39 and therefore will be held against the interior surface of slot 49 formed by body halves 21 and 22, thus retaining the container 23 in its cocked position.

The container 23 may be locked in its cocked position and the trigger 36 in its set position by means of a safety pin 43 which passes through hole 45 in body half 22, next through hole 52 in trigger 36 and hence through hole 44 in body half 21. Holes 44, 45 and 52 are coaxial on assembly and cocking of trigger 36 and are perpendicular to the plane of travel of the trigger 36 such that when safety pin 43 is inserted through holes 44, 45 and 52 the trigger 36 is restrained from moving, thereby, safely retaining the container 23 in its cocked position.

Figure 6:
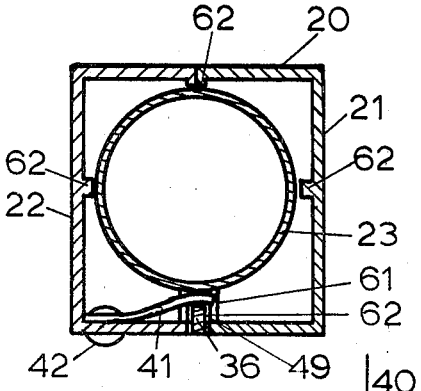
FIG. 6 is a horizontal section taken along line B—B of FIG. 4 showing spring biasing of the trigger.

Now referring to FIGS. 3, 4, 5, 6 and 7, there is shown one type of trigger retaining means for holding the trigger 36 in an actuation position whereby the spring biased container 23 is held in a cocked position and a means to actuate the trigger 36 whereby the trigger 36 is released to allow the container 23 to move to its discharge position. As best seen in FIG. 6, a means for biasing trigger 36 in the direction of arrow 40 is shown as a flat spring 41. The flat spring 41 is shown as being attached at one end to the left housing half 22 by rivets 42, while the other end engages trigger 36. The flat spring 41 should be strong enough to force the latch portion 37 of trigger 36 from engagement with rim 30 of container 23 as the spring 41 causes trigger 36 to move in the direction of arrow 40 when trigger 36 is released.

Figure 7:
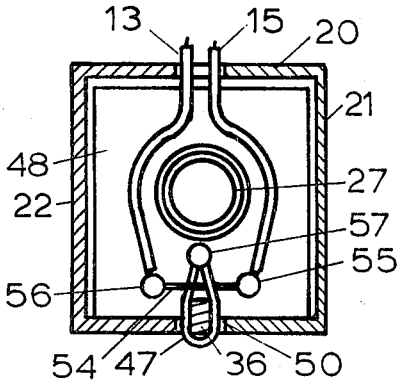
FIG. 7 is a horizontal section taken along line C—C of FIG. 4 showing the trigger actuating means.

One method for releasably retaining trigger 36 is shown in FIGS. 4, 5 and 7. A thermoplastic material arranged to retain trigger 36 is shown for convenience as being a nylon cord 47 looped around trigger 36 and attached structure such as a circuit board 48 by rivets 57 to hold trigger 36 in its actuation position whereby the spring biased container 23 is retained in a cocked position. A means for causing the thermoplastic material to deform whereby the trigger 36 is permitted to move to its release position is shown for convenience as a heating element 54 which is attached to circuit board 48 and wires 13 and 15 by rivets 55 and 56. The heating element 54 is best positioned against or in close proximity to the nylon cord 47 to reduce the amount of heat necessary to deform or melt the nylon cord 47.

Figure 8:
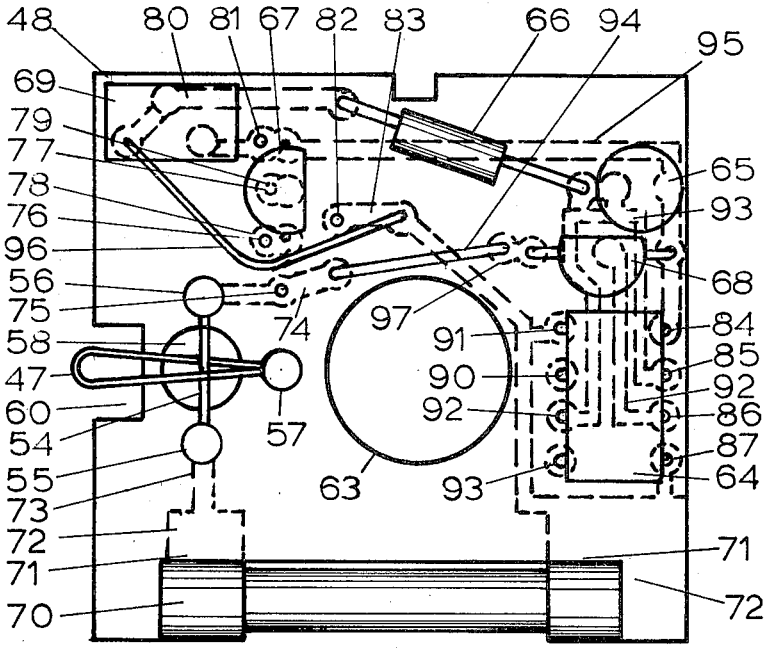
FIG. 8 is an elevational view of a circuit board showing the trigger actuating means and the time delay elements.
Figure 9:
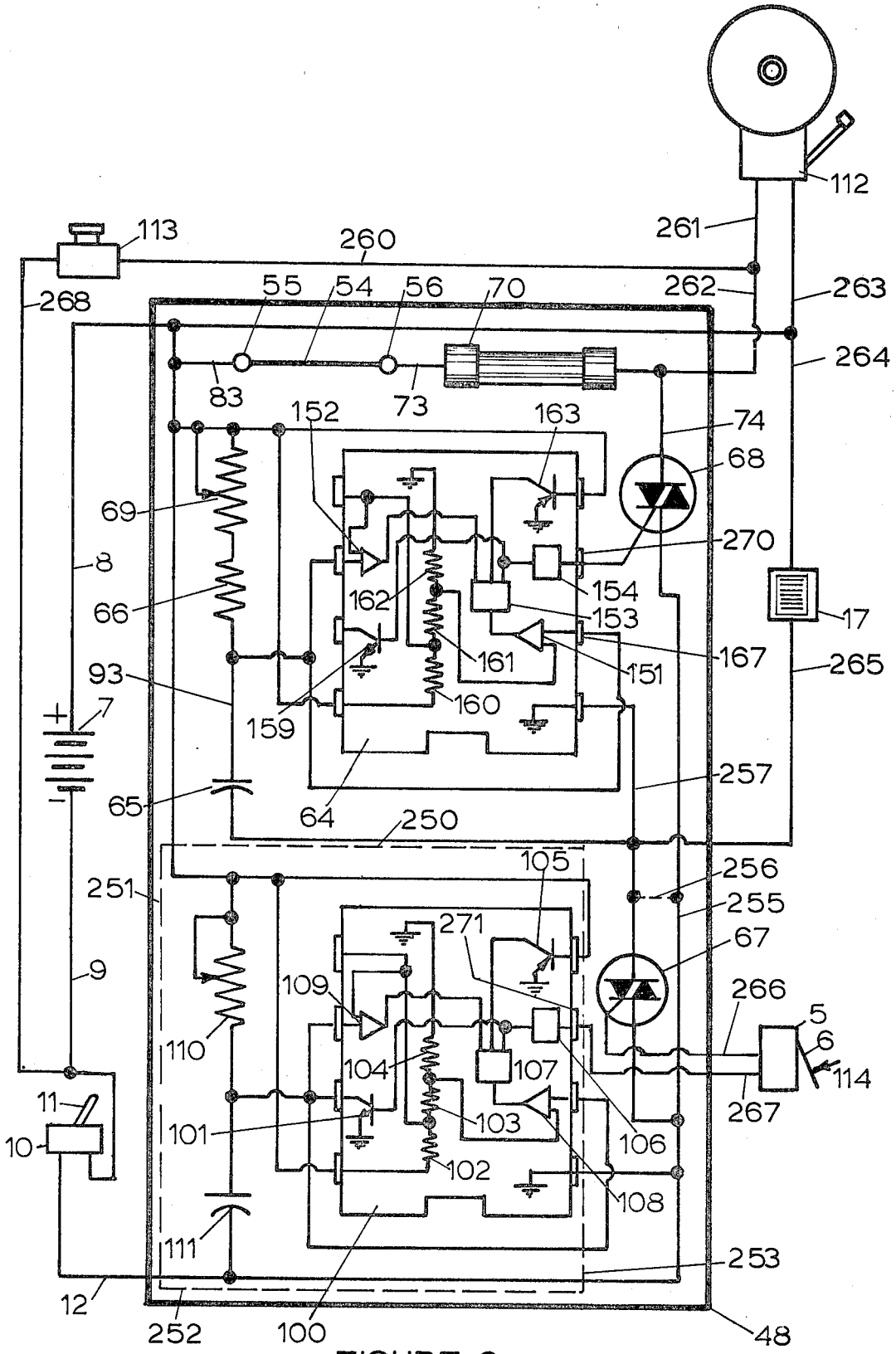
FIG. 9 is a schematic showing the electrical circuitry.

In FIGS. 8 and 9 there is shown one type of electronic circuit for causing the time delayed release of trigger 36 after electric current is applied to the device 1. The time delay elements are shown by convenience as being mounted on a circuit board 48 and is best seen in FIG. 8. The circuit board 48 contains the time delay elements to provide a time delay after electric current is applied to it. A means to provide a second time delay is not shown in FIG. 8 but is shown in FIG. 9 within the area bordered by the dotted lines 250, 251, 252 and 253 and is described in detail in a latter paragraph.

The nylon cord 47 is shown as being attached to the circuit board 48 by rivet 57. The heater wire 54 is mounted in close proximity to the nylon cord 47 and is connected to the circuit board 48 by rivets 55 and 56. A hole 58 is provided beneath the heater wire 54 to prevent the circuit board 48 from absorbing the heat from the heater wire 54. The hole 63 in the circuit board 48 is provided for clearance of spring 27.

The time delay elements may be interconnected by copper lands 72, 73, 74, 78, 80, 83, 95 and 97 after the excess copper not required on the board is etched away by methods for making printed circuit boards which are well known in the trade. Additional connections are made by jumpers 94 and 96.

Electrical components shown on board 48 are: fuse 70, timer integrated circuit 64, an electronic switching element such as triac 67 and triac 68, potentionometer 69, resistor 66 and capacitor 65. The function of these components will become apparent in the detailed description of the circuit.

One type of electronic circuit which can be used to cause the timed release of the trigger 36 is shown in FIG. 9. FIG. 9 shows an electronic circuit which, when all elements are used provides a complete anti-burglary circuit including such features as time delay on exit, time delay on entry, an output for a buzzer, an output for an alarm bell, and a panic switch. The device 1 can operate with the complete circuit or portions thereof.

The electronic circuit shown in FIG. 9 may be adapted to interconnect directly to existing alarm systems to provide a timed delay before releasing the chemical irritant 19 after the alarm is triggered by connecting wire 8 to the positive terminal of the alarm output and wire 255 to the negative terminal of an existing alarm system. Jumper wire 256 shown dotted is added to connect to wire 257 to wire 255.

As shown in FIG. 9, power is supplied to the circuit by a power supply, shown for convenience as a battery 7, the positive lead of the battery 7 is connected to the circuit by wire 8. The negative lead of battery 7 connects to switch 10 through wire 9 and wire 12 connects from switch 10 to circuit board 48. With switch 10 in the "on" or "off" position, contact closure of switch 113 will permit electric current to flow from battery 7 through wire 8 to wire 263, a bell 112, wire 262, wire 260, panic switch 113, wire 268, wire 9 and the negative terminal of battery 7, thereby causing bell 112 to sound. In addition, power will be supplied through fuse 70 and heater wire 54, thereby causing an instant release of chemical irritant 19 in an emergency situation.

When switch 10 is in the "on" position, electric current is permitted to flow from the positive terminal of battery 7 through wire 8 to circuit 48 and from the negative terminal of battery 7 through wire 9 to switch 10, through switch 10 and wires 12 to circuit board 48. The circuits for causing the timed delay periods is shown for convenience as comprising of the type 555 monolithic timing circuits, generally designated 64 and 100. Originally developed by "Signetics Corporation," 811 East Arques Avenue, Sunnyvale, Calif., 94086, the 555 and similar integrated timing circuits are now produced by several other semiconductor manufacturers such as Texas Instruments Semiconductor Group, P.O. Box 5012, Dallas, Texas 75222; and R.C.A. Solid State Division, Route 202, Sommerville, N.J. 08876 and are available at most electronic supply houses.

The 555 timer, generally designated 64, contains two comparators 151 and 152, a flip flop 153 and a power output stage 154. With the external resistor 66, a variable external resistor 69 and an external capacitor 65, the timer 64 can be used for precise timing.

The operation of the timing circuit may be understood by referring to the block diagram shown within timer 64. When electric current is applied to timer 64, the output 270 is at ground potential. The three internal resistors 160, 161, and 162 act as voltage dividers, providing bias voltages of two-thirds of the battery voltage and one-third of the battery voltage respectively. Since these two voltages fix the necessary comparator threshold voltages, they also aid in determining the timing interval.

Since the comparator 151 is biased at one-third the supply voltage, it remains in the standby state so long as the trigger 167 is held above one-third the supply voltage. As power is supplied to the external timing capacitor 65 through variable resistor 69 and resistor 66, the voltage in capacitor 65 rises toward the supply voltage. After a period of time, the capacitor voltage will equal two-thirds the supply voltage and the comparator 152 resets the internal flip-flop 153 which "turns-on" output 270.

When the output 270 is in the "on" condition, an electronic switching element such as a triac 68 is switched "on" to pass electric current through the fuse 70 and heater wire 54. In addition, electric current is supplied to bell 112.

Now referring to the overall circuit, when switch 10 is in the "on" position, electric current is supplied to timer 100 and capicator 111 through variable resistor 110. Timer 100 operates like timer 64 previously described and provides an "exit" delay. If switch 5 were located on an exit door and switch 10 in the protected area, opening the exit door with switch 10 turned "on" would cause device 1 to dicharge chemical irritant 19 after its timed delay. Timer 100 provides a timed delay of the electric current to timer 64 and its related circuit to provide means for leaving the protected area if it is desired to place switch 10 in the protected area. A time delay "turn-on" of approximately 1 minute is obtained if capacitor 111 has a value of 47 microfarads and the resistor 110 has a value of approximately 1.2 megohms.

After timer 100 completes its time delay, the output 271 is provided to the gate of triac 67 through sensor switch 5 and the system is "armed". There will be no action until an attempt is made to enter the protected area and sensor switch 5 is closed which turns triac 67 "on". Since triac 67 is operating on a direct current power supply, it "locks-in" and supplies power to timer 64 and buzzer 17. "Opening" the contacts of switch 5 will not stop device 1 from discharging after the time delay of timer 64.

If switch 10 is not turned to the "off" position, timer 64 will "turn-on" triac 68 after a time delay determined by the values of capacitor 65 and the variable resistor 69 and resistor 66, causing heater 54 to melt the nylon cord 47 thereby releasing trigger 36 to cause discharge of chemical irritant 19.

After electric current has been supplied to the heater 54 and fuse 70 and the device 1 is discharging, it is desirable to stop the electric current flowing through the heater 54. One means for stopping the electric current flow is by using a slo-blow fuse, which is well known in the trade, and permitting approximately double the rated current to flow through it. The slo-blow fuse will open in approximately 20 seconds thereby stopping the electric current flow in the heater circuit.

It is an important feature that the trigger 36 be rotatable and that the shaped latch portion 37 thereof present a surface which will slide smoothly on the rim 30 of the container 23 when the trigger 36 is released. As a consequence the trigger 36 may be easily withdrawn from engagement without substantial force. Yet when the trigger 36 is positioned in engagement with the rim 30 of the container 23, the trigger 36 serves to positively retain container 23 in its cocked position. Hence substantially less force is required to trigger device 1 of the present invention than would be required if the container 23 were retained in its cocked position by means of a transversely extending trigger pin or the like, yet the container 23 is still safely retained in its locked position against accidental release by safety pin 43 passing through holes 44, 45 and 52.

Yet another important feature is that the dispensing head 18 is rotatable in socket hole 34 through a large angle up to 360 degrees so that the fluid 19 may be directed into any area relative to the triggering object.

Another important feature is that the spring 27 be of substantial force so that the projecting dispensing spout 31 will seat in the entry section 32 with sufficient force to release the pressurized fluid through the passageway 33 and out the dispensing head 18.

It is also important that the thermoplastic material deform when an electric current is applied to the device after a preset time delay. Therefore the thermoplastic material may be of any material that will deform when heated to cause discharge.

Security from accidental release is achieved by keeping the trigger 36 flush with or recessed from the exterior surface of the body halves 21 and 22. By mounting the trigger 36 in the body halves 21 and 22 in this manner, there is no surface of the trigger 36 exposed to grip and therefore cannot be released.

It is also important in this embodiment that the fluid-dispensing element comprises of a dispensing valve 200 having a projecting dispensing spout 31 which when depressed causes fluid discharge therethrough. The fluid passageway 33 contains the fluid dispensing-actuating means in the form of a funnel shaped entry section 32 which engages the projecting dispensing spout 31 and forms a seal between the entry section 32 of passageway 33 and the projecting dispensing spout 31.

Although the device 1 is shown as having the fluid passageway 33 contained in a rotatable dispensing head; the passageway may also be formed in the body member 1.

Figure 10:
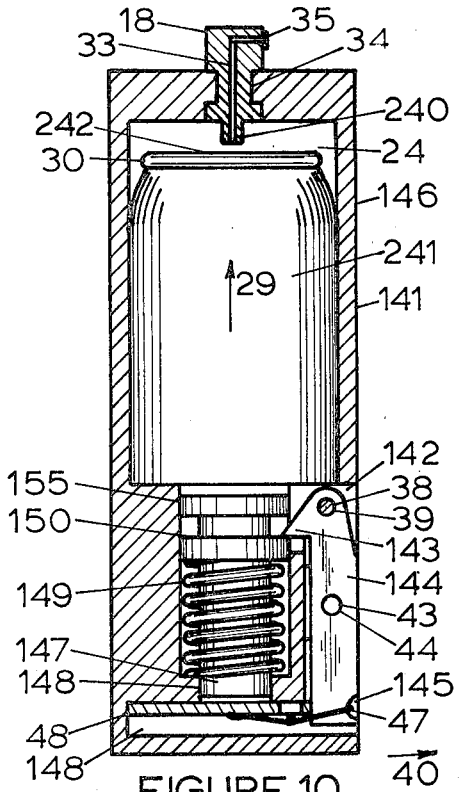
FIG. 10 is a vertical section similar to FIG. 4 but showing a second embodiment of the anti-burglar device containing a pressurized container of the type with a recessed valve and a spring biased element which causes movement of the pressurized container.

A second embodiment of the invention is illustrated in FIG. 10. In this embodiment the basic structure is as previously described and like numbers are used to indicate like or corresponding parts.

In this embodiment, the pressurized fluid container 23, shown in FIG. 4 having a projecting dispensing spout 31, is replaced with a pressurized fluid container 241 shown in FIG. 10, having a recessed valve. Pressurized containers of the aerosol type with a recessed dispensing valve are well known in the trade. In addition, the funnel shape of the entry section 32 of the fluid passageway 33 of the first embodiment shown in FIG. 4 is replaced with projecting spout 240 depending from dispensing head 18, all of which are shown in FIG. 10.

In this embodiment, all elements function as described in the first embodiment with the following difference. The pressurized container 241 is discharged by the action of the spring loaded plunger 155 moving the pressurized container 241 such that the recessed valve of the pressurized container 241 is depressed through engagement with projecting spout 240 and thereby effects discharge.

Figure 15:
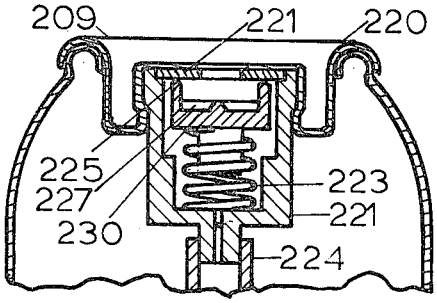
FIG. 15 is a partial vertical section showing a valve for use with a pressurized container having a recessed valve.

One type of recessed valve for use in this embodiment is shown in FIG. 15 and is generally designated 220. Valve assemblies of this type are well known in the trade and one type of which is sold by Scovill, Manchester, New Hampshire. The valve assembly 220 is shown as being comprised of a valve seat 225 mounted in a spring cut 222. The valve seat 225 contains a recessed portion 230 and recessed channels 227 formed in valve seat 225.

The valve seat 225 is slidably mounted in spring cup 222 and is urged by spring 223 toward valve seal 221. In this position, the valve seat 225 forms a fluid seal with the valve seal 221. The valve assembly 220 is generally mounted in a metal cup 209 which is then fastened to the pressurized container 241.

When the device 141 is triggered, the valve assembly 220 is moved along with the pressurized container 241 in the direction of arror 29. As movement continues, the projecting spout 240 of the dispensing head 18 engages with and moves the valve seat 225 from engagement with valve seal 221 permitting fluid under pressure to flow around the valve seat 225, through the discharge channels 227 and out passageway 33. When the projecting spout 240 entered the valve assembly 220, the valve seal 221, being made of resilient material, formed a seal between the circumference of the projecting spout 240 and the valve seal 221, thus preventing fluid leakage.

The fluid 19 is then discharged through the valve 220 of the pressurized container 241, through the entry section 242 and passageway 33 and out the dispensing head 18, then into the area to be protected.

As shown in FIG. 10, when the nylon cord 47 melts, the trigger 144 is rotated. This causes the shaped latch portion 143 to be moved from plunger rim 150 and permits the container 241 to be moved in the direction of arrow 29, causing discharge through the action of the projection dispensing spout 240 acting on the recessed valve 220 of container 241. The fluid will then be forced up through passageway 33 and dispersed through orifice 35.

It is important in this embodiment that the fluid-dispensing element comprises of a recessed valve assembly 220 which when depressed causes fluid discharge. It is also important that the entry section 242 of passageway 33 contain a fluid dispensing element-actuating means in the form of a projecting spout 240 which engages with the recessed valve assembly 220 and causes fluid discharge.

Figure 11:
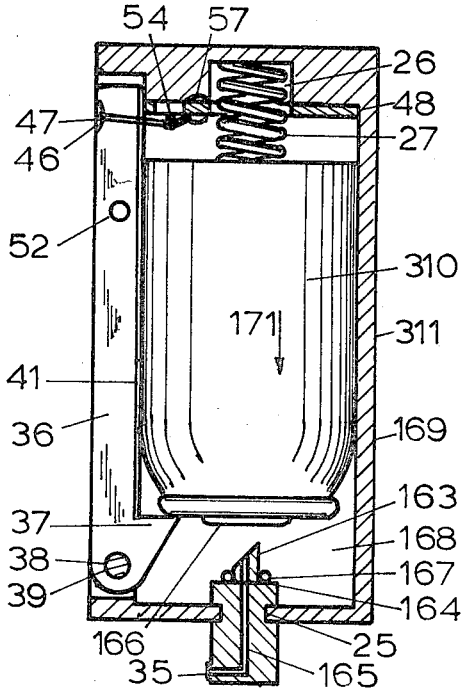
FIG. 11 is a vertical section similar to FIG. 4 but showing a third embodiment containing a pressurized container having a pierceable seal and means for piercing the seal.

A third embodiment of the invention is illustrated in FIG. 11. In this embodiment the structure is as previously described in the first embodiment and like numbers are used to indicate like or corresponding parts.

In this embodiment, the pressurized fluid container 23, shown in FIG. 4 of the first embodiment and having a projecting dispensing spout 31, is replaced with a pressurized fluid container 310 shown in FIG. 11, having a pierceable seal 166. Pressurized containers having pierceable seals are well known in the trade. In addition, the funnel shaped entry section 32 of the body halves 21 and 22 of the first embodiment shown in FIG. 4 is replaced with body halves 168 and 169 having a projecting section 163 shaped to pierce seal 166 and a means of making a fluid seal capable of withstanding the pressure required for effectively discharging fluid through the passageway 165 and into the restricted area.

Now referring to FIG. 11, FIG. 11 is an inverted embodiment of FIG. 4 of the first embodiment in which all elements function as described in the first embodiment with the following exceptions. The pressurized container 310, when released by trigger 36, is forced by spring 27, into piercing engagement with the piercing projecting section 163. As the pierceable seal 166 is pierced by the action of the projection forward section 163, the spring 27 continues to move the container 310, forming a seal by the action of the O-Ring 167 and its retaining seat 164 and the pierceable seal 166 of the pressurized container 310. The fluid 19 is then discharged through the pierced seal 166 of the pressurized container 310, through passageway 165, out the orifice 35 and then into the area to be protected.

It is important in this embodiment that the fluid-dispensing element comprises a pierceable seal 166 which when pierced will permit fluid discharge therethrough.

It is also important that the dispensing element-actuating means comprise of a projecting piercing section 163 set in a position to pierce the pierceable seal 166 when the pressurized container 161 is moved toward it. It is also important that a seal be made around the projecting piercing section 163 to prevent fluid leakage within the body member 311 after the pierceable seal is pierced.

The preceeding embodiments of the invention show the fluid dispensing anti-burglary device in its preferred embodiments containing a rotatable trigger 36 but it is recognized that the trigger 36 may be slidably mounted. In addition, the body member may be constructed in a different manner.

Figure 12:
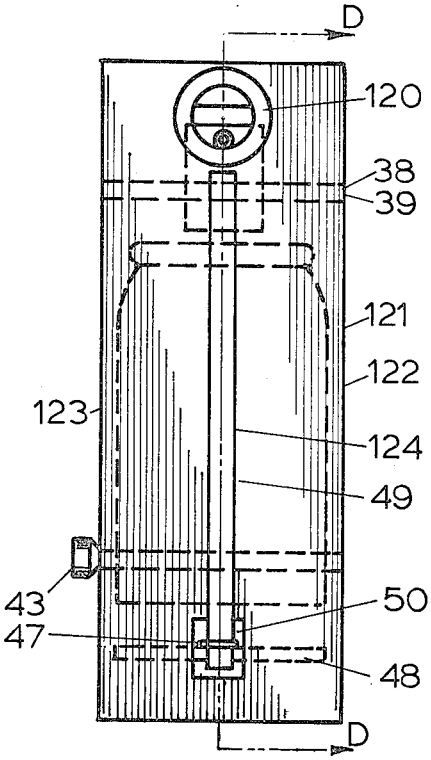
FIG. 12 is a front elevational view similar to FIG. 3 but showing a fourth embodiment of the fluid dispensing anti-burglar device containing a pressurized container of the aerosol type having a projecting dispensing cap.
Figure 13:
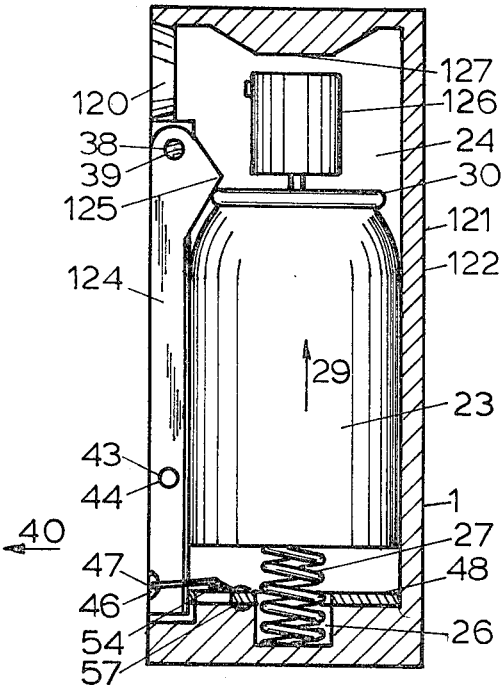
FIG. 13 is a vertical section taken along line D—D of FIG. 12 showing the spring biased element in a cocked position.

A fourth embodiment of the invention is illustrated in FIGS. 12 and 13. In this embodiment, the structure is as previously described in the first embodiment and like numbers are used to indicate like or corresponding parts.

In this embodiment, the projecting dispensing spout 31 of pressurized fluid container 23, shown in FIG. 4, is replaced with a projecting dispensing cap 126 shown in FIG. 12 and 13. In addition, the fluid passageway 33 and the entry section 32 are replaced with an aperture 120.

Now referring to FIG. 12 and FIG. 13, the spring 27 and trigger actuating means operate as before to move the pressurized container 23. In this embodiment, the spring 27 urged pressurized container 23 causes the projecting cap 126 to be depressed against the inside top portion 127 of body halves 122 and 123; thereby causing discharge through aperture 120.

It is important in this embodiment that the fluid-dispensing element comprise of a projecting dispensing cap 126 which when depressed causes fluid discharge therethrough. The body member 121 contains an aperture 120 in communication with the projection dispensing cap 126 to provide for fluid discharge from the body member 121. A dispensing element-actuating means is provided by the surface 127 which will depress the dispensing cap 126 when the container 23 is moved toward it and thereby cause fluid discharge.

In the anti-burglar device 1 previously described, the trigger 36 is released when nylon cord 47 is separated. The trigger 36 holds the pressurized container in a cocked position. In this embodiment, the trigger 36 is replaced by a self-camming trigger 124 as best seen in FIGS. 12 and 13 wherein the self-camming trigger 124 will be forced to rotate in the direction of arrow 40 by the action of the rim 30 of the pressurized container 23 of the spring 27 urged pressurized container 23.

Figure 16:
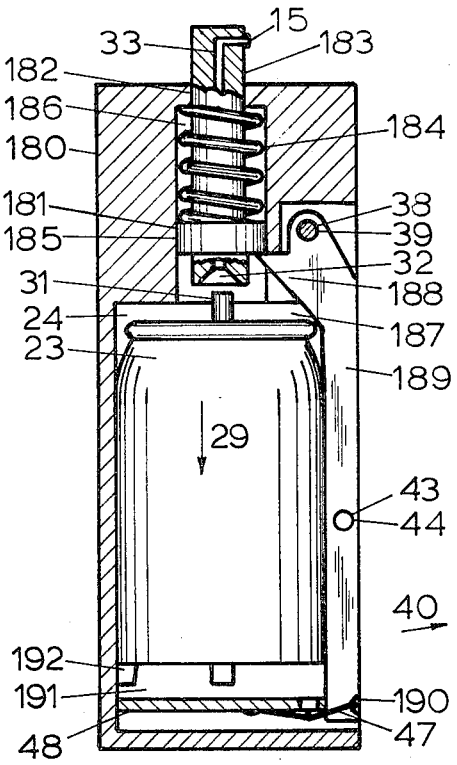
FIG. 16 is a vertical section similar to FIG. 4 but showing a fifth embodiment containing a trigger working on a spring biased dispensing element actuator.

A fifth embodiment of the invention is illustrated in FIG. 16. In this embodiment, the basic structure is as previously described in the first embodiment and like numbers are used to indicate like or corresponding parts. The fluid dispensing anti-burglary device of this embodiment is generally noted device 180.

In this embodiment, the trigger 36 of the first embodiment is replaced with a trigger 189 which is made to work on biased actuating member 181. The trigger 189 operates in the manner previously described.

The trigger 189 retains a biased actuating member 181 in a cocked position. The biased actuating member 181, one type of which is shown as having two cylindrical portions 183 and 185. The body member 180 contains coaxial bores 182 and 186 to slidably mount the biased actuating member 181. A spring 184 is mounted in its spring cavity 186 and urges the biased actuating member 181 in the direction of arrow 29.

When the trigger 189 is released, the trigger 189 rotates around shaft 39 and slides its catch 188 from engagement with the biased actuating member 181. The spring 184 urges the biased actuating member 181 in the direction of arrow 29 to cause discharge.

Figure 17:
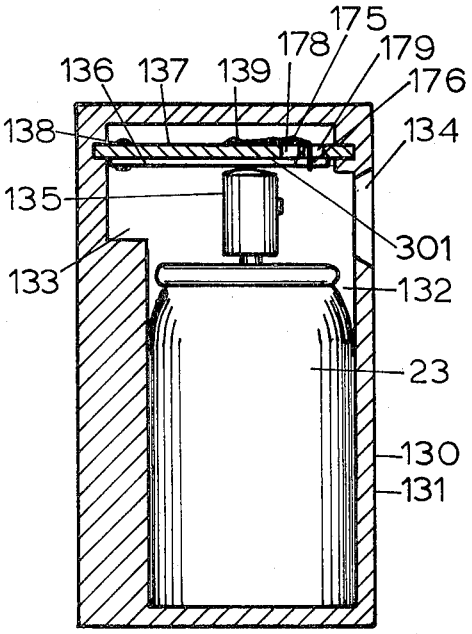
FIG. 17 is a vertical section showing a sixth embodiment containing a pressurized container having a fluid dispensing cap and the trigger actuator deployed to actuate the dispensing cap.
Figure 18:
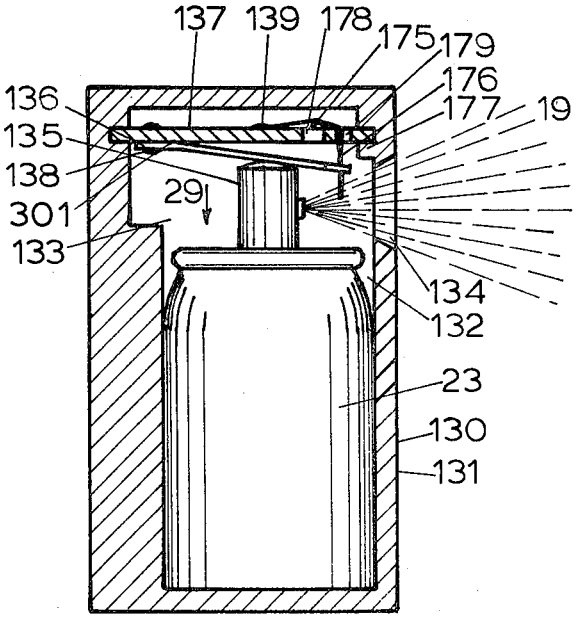
FIG. 18 is a vertical section similar to FIG. 17 but showing the dispensing cap depressed and the device discharging fluid.

A sixth embodiment of the invention is illustrated in FIGS. 17 and 18. In this embodiment, the basic structure is as previously described and like numbers are used to indicate like or corresponding parts. The fluid dispensing anti-burglary device of this embodiment is generally noted device 130.

Figure 19:
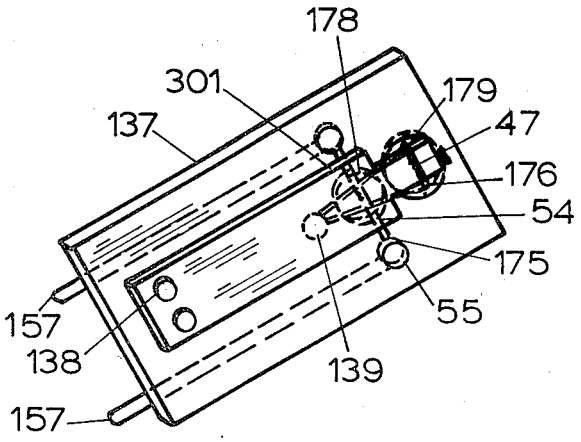
FIG. 19 is an elevational view of the trigger assembly which is shown in FIG. 17.

In the anti-burglar device 1 previously described, the trigger 36 is released when nylon cord 47 is separated. The trigger 36 holds the spring biased pressurized container 23 in a cocked position. In this embodiment, the trigger 36 is replaced by trigger 301 as best seen in FIGS. 17, 18 and 19.

The trigger 301 is shown for convenience as being a flat spring fastened to one end of the printed circuit board 137 by rivets 138 and held in actuation position at the other end by nylon cord 176. The spring trigger 301 is biased in the direction arrow 29. The nylon string 176 is shown for convenience as being attached to board 137 by rivets 139 and passes in close proximity to heater wire 175 and through hole 179 to hold the spring trigger 301.

The pressurized container 23 includes a dispensing cap 135 which when depressed will cause fluid discharge. When electric current is applied to device 130, the heater wire 175 will cause the nylon cord 176 to separate after time delay and permit spring trigger 301 to move in the direction of arrow 29 to its release position. Spring trigger 301 moving in the direction of arrow 29 will depress dispensing cap 135, causing the discharge of fluid from pressurized container 23, through dispensing cap 135 and out aperture 134.

Figure 20:
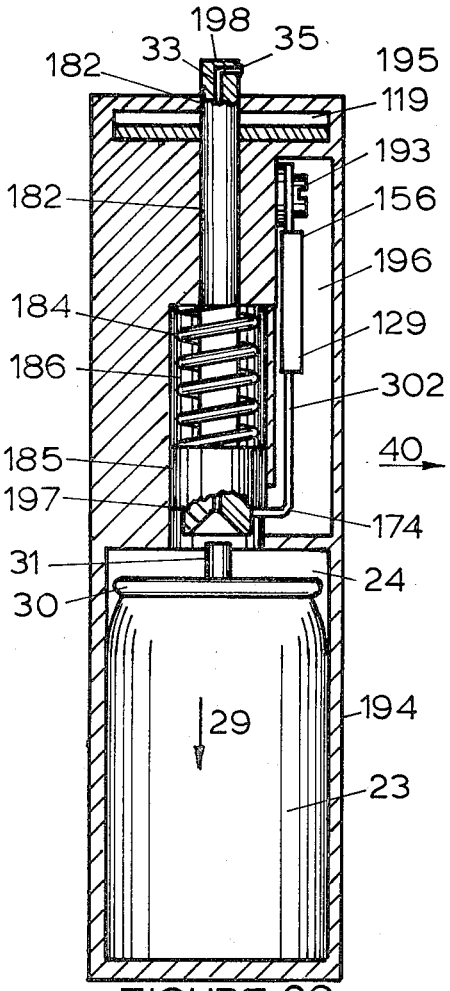
FIG. 20 is a vertical section similar to FIG. 4 but showing a seventh embodiment of the anti-burglary device containing an electrothermal trigger.
Figure 21:
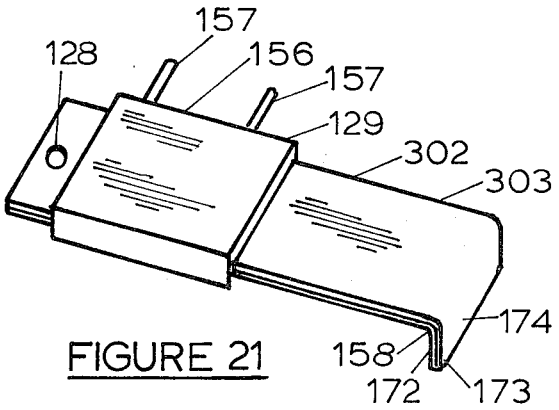
FIG. 21 is an elevational view of the electrothermal trigger.

A seventh embodiment of the invention is illustrated in FIGS. 20 and 21. In this embodiment, the structure is as previously described in the fifth embodiment and like numbers are used to indicate like or corresponding parts.

In this embodiment the trigger 189 is replaced by an electrothermal trigger generally designated 302. The electrothermal trigger 302 is best shown in FIG. 21 as being comprised of bimetal strip 158 made of two different materials and having two different coefficients of thermal expansion. Applied heat will cause the bimetal strip 158 to bend because of the different thermal expansion properties of the dissimilar materials used. A latch portion 174 is formed on the trigger extension 303 of the electrothermal trigger 302 and hole 128 for mounting in the housing 194 is formed on the other end. A heating coil 129 is attached to the bimetal strip 158 to provide heat when electric current is passed through the heating coil 129.

The electrothermal trigger 302 is mounted in the body member 194 as best seen in FIG. 21. The latch portion 174 of the electrothermal trigger 302 engages with the biased actuating member 197 to retain the actuating member 197 in its cocked position.

As electric current is applied to the heating coil 129, bending caused by the expansion of the dissimilar materials will cause the electrothermal trigger 302 to move in the direction of arrow 40, thereby releasing the biased actuating member 197 to cause fluid discharge as previously described in the fifth embodiment.

Figure 22:
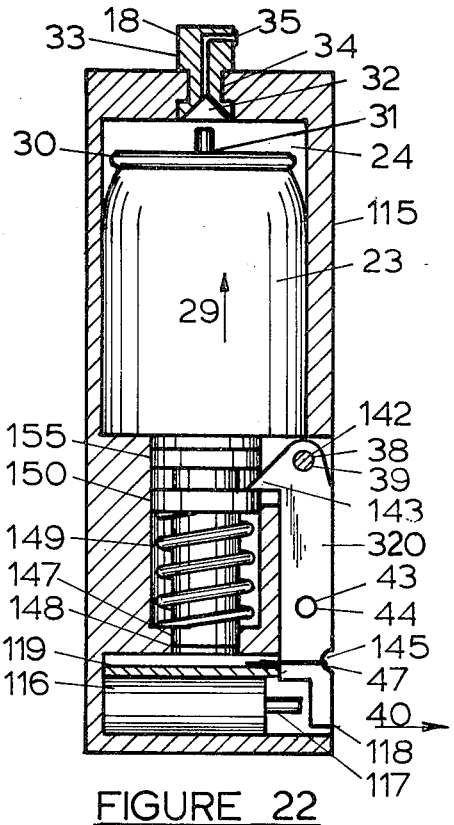
FIG. 22 is a vertical section similar to FIG. 4 but showing an eighth embodiment containing an electromechanical actuator for releasing the trigger.

An eighth embodiment of the invention is illustrated in FIG. 22. In this embodiment, the structure is as previously described in the second embodiment and like numbers are used to indicate like or corresponding parts.

In this embodiment, the trigger 144 is replaced by a trigger 320 which includes an extension 118. In addition, the device 115 is equipped with an electromechanical actuator 116 of the solenoid push type wherein the solenoid plunger 117 is mounted to engage the extension 118 of trigger 320.

The device 115 is installed and operates in the manner described in the second embodiment. As the solenoid coil 116 is energized and the plunger 117 moves in the direction of arrow 40, pushing on extension 118 of trigger 320. This releases the biased actuating member 155, previously described and discharges the device.

The chemical dispensing anti-burglary device described herein in several embodiments was generally shown with a pressurized container 23 with a projecting dispensing spout 31 mounted to discharge into a funnel shaped entry section 32 of a fluid passageway 33 when the device is discharged. Alternately the device will also function with a pressurized container of the aerosol type with a recessed valve by providing a tubular member depending from the body member to cause discharge; in addition the devices can be used with a sealed pressurized container with a pierceable seal; also the aerosol type container with a dispensing projecting cap wherein the projecting cap is depressed to cause discharge; but the invention is not limited to these of containers.

Although I have herein shown and described the invention in what I have conceived to be the most practical and preferred embodiments, it is recognized that departure may be made therefrom within the scope of my invention, which is not to be limited to the details disclosed herein, but is to be accorded the full scope of the claims so as to embrace any and all equivalent structures and devices.

I claim:

1. A fluid dispensing anti-burglar device for use with a pressurized container, the device comprising:

(a) a body member;

(b) means for supporting said pressurized container in said body member, wherein said pressurized container has a fluid-dispensing element adapted to release fluid under pressure from said pressurized container when actuated;

(c) a passageway in said body member having an entry section at one end thereof;

(d) dispensing element-actuating means mounted in said body member and adapted to engage and actuate said fluid-dispensing element;

(e) spring means biased to force said fluid-dispensing element and said dispensing element-actuating means into engagement with each other, thereby causing said fluid-dispensing element to be actuated;

(f) trigger means adapted to releasably retain said spring means in a cocked position in which said fluid-dispensing element and said dispensing element-actuating means are separated from each other;

(g) trigger-actuating means associated with said trigger to actuate said trigger upon the application of an electric current to said trigger-actuating means, whereby said spring is released from its cocked position causing said fluid-dispensing element to be actuated, and fluid under pressure is released from said container to pass through said passageway;

(h) delay means for causing the delay of the application of electric current to said trigger-actuating means after electric current is applied to said device, thereby permitting the removal of said electric current if the electric current is accidentally applied to the device;

(i) and a circuit board containing the trigger-actuating means and the delay means mounted within said body member.

2. The fluid dispensing anti-burglar device of claim 1 in which said fluid-dispensing element of the pressurized container comprises a pierceable section, means to provide a seal between said pierceable section and said entry section, and means for puncturing said pierceable section, whereby fluid may be discharged.

3. The fluid dispensing anti-burglar device of claim 2 in which said means for puncturing comprises a projecting spout depending from said body member.

4. The fluid dispensing anti-burglar device of claim 1 wherein said trigger is mounted for movement between an actuation position and a release position, said trigger when in said actuation position retaining said spring means in said cocked position, and said trigger when in said release position allowing said spring means to actuate said fluid-dispensing element, thereby causing fluid discharge.

5. The fluid dispensing anti-burglar device of claim 1 wherein said trigger is mounted for rotation between an actuation position and a release position, said trigger when in said actuation position retaining said spring means in said cocked position, and said trigger when in said release position allowing said spring means to actuate said fluid-dispensing element, thereby causing fluid discharge.

6. The fluid dispensing anti-burglar device of claim 1 wherein said trigger is in shouldered engagement with said spring means to retain said spring means in a cocked position.

7. The fluid dispensing anti-burglar device of claim 1 wherein said trigger is in cammed engagement with a shaped surface of said spring means to retain said spring means in an actuation position, said shaped surface of said spring means arranged to move said trigger from said actuation position to a release position, means for releasably retaining said trigger in said actuation position wherein said trigger is in engagement with said spring means, said releasably retaining means mounted for movement between a holding position and a release position, said holding means in said holding position securing said trigger in engagement with said shaped surface of said spring means, said holding means in said release position permitting said trigger to move to its release position.

8. The fluid dispensing anti-burglar device of claim 1 wherein said fluid-dispensing element of said pressurized container includes a dispensing valve actuated to permit fluid discharge therethrough upon depression thereof, said valve being actuated to said release position through movement caused by the release of said spring means whereby the valve is depressed and fluid is discharged.

9. The fluid dispensing anti-burglar device of claim 8 wherein said valved pressurized container contains a projecting dispensing spout, said dispensing spout discharging fluid upon depression thereof, said entry section of said passageway being funnel shaped for receiving said projecting dispensing spout on said container.

10. The fluid dispensing anti-burglar device of claim 8 wherein said valved pressurized container includes a recessed valve, said body member includes a projection in said entry section extending beyond said entry section toward said container to engage said recessed valve, said recessed valve actuated upon depression thereof to emit fluid.

11. The fluid dispensing anti-burglar device of claim 8 wherein said valved pressurized container contains a projecting dispensing cap actuated to permit fluid discharge therethrough upon depression thereof, an aperture in said body member in communication with said cap, said spring means arranged to actuate said dispensing cap upon release thereby discharging said pressurized container through said cap and aperture when said spring means is released.

12. The fluid dispensing anti-burglar device of claim 1 wherein said trigger-actuating means associated with said trigger includes a thermoplastic retainer to releasably retain said trigger in an actuation position, trigger spring means biased to force said trigger toward a release position and an electric element located in a position to cause said thermoplastic retainer to release said trigger when an electric current is passed through said electric element whereby said trigger is moved to said release position by said trigger spring means when released by said thermoplastic retainer.

13. The fluid dispensing anti-burglar device of claim 1 wherein said trigger-actuating means associated with said trigger comprises a means for electromechanically retaining and releasing said trigger.

14. The fluid dispensing anti-burglar device of claim 13 wherein said electromechanical retaining-releasing means of said trigger comprises a solenoid latch lever for retaining said trigger in an actuation, position whereby said spring means is held in a cocked position, said solenoid lever being resiliently held in engagement with said trigger to retain said spring means in said cocked position, and a magnetic cored coil for moving said solenoid lever out of engagement with said trigger whereby said trigger moves to said release position.

15. The anti-burglar fluid dispensing device of claim 1 wherein said trigger-actuating means associated with said trigger comprises a solenoid containing an electromagnetic coil and a plunger, said electromagnetic coil and plunger being mounted to cause release of said trigger when said electromagnetic coil is electrically energized.

16. The fluid dispensing anti-burglar device of claim 1 wherein the trigger comprises of an electrothermal trigger, said electrothermal trigger comprising of a bi-metal trip which deflects upon application of heat, an electric resistance heater arranged to heat said bi-metal strip, said electrothermal trigger arranged to hold said spring means in a cocked position, and said electrothermal trigger to release said spring means when heat is applied said electrothermal trigger when an electric current is passed through said electric resistance heater thereby causing fluid discharge.

17. The fluid dispensing anti-burglar device of claim 1 wherein the spring means comprises a spring biased actuating member arranged to actuate said fluid-dispensing element after a time delay.

18. The fluid dispensing anti-burglar device of claim 1 wherein said pressurized container is slidably supported in said body member and spring biased toward said dispensing element-actuating means, said trigger in an actuation position is arranged to engage and hold said pressurized container in a cocked position whereby the fluid-dispensing element of said pressurized container is displaced from said dispensing element-actuating means, said trigger in a release position permitting said fluid-dispensing element of said spring biased pressurized container to be moved into engagement with the dispensing element-actuating means to cause fluid discharge.

19. The fluid dispensing anti-burglar device of claim 1 wherein said pressurized container is slidably supported in said body member, the spring means comprising a spring biased actuating member slidably supported in said body member and arranged to move said slidably supported pressurized container toward said dispensing element-actuating means, said trigger in an actuation position arranged to engage and hold said biased actuating member in a cocked position whereby said pressurized container is displaced from the biased actuating member, said trigger element in a release position permitting said spring biased actuating member to move said fluid-dispensing element of said pressurized container into engagement with said dispensing element-actuating means, thereby causing fluid discharge.

20. The fluid dispensing anti-burglar device of claim 1 wherein said spring means comprises a spring biased actuating member containing said dispensing element-actuating means and arranged for movement in said body member, said trigger in an actuation position arranged to engage and hold said spring biased actuating member in a cocked position whereby said dispensing element-actuating means is displaced from said fluid-dispensing element, said trigger in a release position permitting said spring biased actuating member to be moved toward said pressurized container such that said dispensing element-actuating means engages with said fluid-dispensing element, thereby causing fluid discharge.

21. The fluid dispensing anti-burglar device of claim 1 wherein the delay means comprises an electronic circuit for causing the time delayed switching of electric current to said trigger-actuating means.

22. The fluid dispensing anti-burglar device of claim 1 wherein the delay means includes a monolithic timing circuit for causing the time delayed switching of electric current to said trigger-actuating means.

23. The fluid dispensing anti-burglar device of claim 1 wherein the delay means comprises in combination:

a monolithic timing circuit, an external resistor and capacitor connected in series to provide a timing means for the monolithic timing circuit, an electronic switching element controlled by the monolithic timing circuit to switch electric current to said trigger-actuating means.

24. The fluid dispensing anti-burglar device of claim 1 wherein the delay means comprises in combination:

a monolithic timing circuit, an external resistor and capacitor connected in series to provide timing means for the monolithic timing circuit, an electronic switching element controlled by the monolithic timing circuit to switch electric current to said trigger-actuating means, a second monolithic timing circuit, a second series connected resistor and capacitor to provide timing means for said second monolithic timing circuit, and a second electronic switching element controlled by the second monolithic timing circuit to switch electric current to the first monolithic timing circuit after electric current is applied to said device.

25. The fluid dispensing anti-burglar device of claim 1 wherein the delay means comprises in combination:

a monolithic timing circuit, an external resistor and capacitor connected in series to to provide timing means for the monolithic timing circuit, an electronic switching element controlled by the monolithic timing circuit to switch electric current to said trigger-actuating means, a second monolithic timing circuit, a second series connected resistor and capacitor to provide timing means for said second monolithic circuit, a second electronic switching element controlled by said second monolithic timing circuit to switch electric current to the first monolithic timing circuit after current is applied to said device, and a means for stopping the electric current flow of said trigger-actuating means after the device is discharging fluid.

26. The fluid dispensing anti-burglar device of claim 1 wherein said trigger-actuating means includes a spring biased trigger, said spring biased trigger arranged wherein said spring biased trigger is forced from an actuation position wherein said spring means is releasably retained in a cocked position to a release position where said spring means is released to cause discharge.

27. The fluid dispensing anti-burglar device of claim 26 wherein said trigger-actuating means associated with said spring biased trigger includes a means for releasably retaining said spring biased trigger in said actuation position.

* * * * *